US005676242A

United States Patent [19]

Scott

[11] Patent Number: 5,676,242

[45] Date of Patent: Oct. 14, 1997

[54] CASE FOR EYEGLASSES AND SUNGLASSES

[76] Inventor: Michael James Scott, 289 Morris Ave., Springfield, N.J. 07081

[21] Appl. No.: 701,648

[22] Filed: Aug. 26, 1996

[51] Int. Cl.[6] ..... A45C 11/04

[52] U.S. Cl. ..... 206/5; 206/6

[58] Field of Search ..... 206/5, 6

[56] References Cited

U.S. PATENT DOCUMENTS

| | | | |
|---|---|---|---|
| 1,995,664 | 3/1935 | Boyes | 206/5 R |
| 2,650,700 | 9/1953 | Wolf | 206/5 R |
| 3,144,127 | 8/1964 | Fogel | 206/5 R |
| 4,148,422 | 4/1979 | Habler | 206/5 |
| 4,984,682 | 1/1991 | Cummins | 206/5 |
| 5,123,525 | 6/1992 | Orlowski | 206/5 |
| 5,513,744 | 5/1996 | Yabarra | 206/5 |

FOREIGN PATENT DOCUMENTS

| | | | |
|---|---|---|---|
| 1046294 | 12/1953 | France | 206/5 R |

*Primary Examiner*—Paul T. Sewell
*Assistant Examiner*—Nhan T. Lam

[57] ABSTRACT

A case for eyeglasses and sunglasses comprising: a case formed in first and second sections, the first section having a front wall, a rear wall, a top wall, a bottom wall and two side walls, the front wall comprising a lower section formed contiguously with the bottom wall and an upper section formed contiguously with the top wall, the upper section being formed as a generally triangular shaped flap, the upper section being folded over the lower section and coupled thereto, the first section adapted to contain a pair of eyeglasses; and the second section having a front wall, a rear wall, a top wall, a bottom wall and two side walls, the front wall being secured to the rear wall of the first section, the top wall including a coupling device, the second section adapted to contain a pair of sunglasses, in an operative orientation a user carrying a pair of eyeglasses and a pair of sunglasses within the apparatus.

1 Claim, 3 Drawing Sheets

CASE FOR EYEGLASSES AND SUNGLASSES

BACKGROUND OF THE INVENTION

1. Field of the Invention

The present invention relates to a case for eyeglasses and sunglasses and more particularly pertains to enabling users to carry both eyeglasses and sunglasses in a single case.

2. Description of the Prior Art

The use of cases for glasses is known in the prior art. More specifically, cases for glasses heretofore devised and utilized for the purpose of holding eyeglasses are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,865,186 to Gates discloses a eyeglass and contact lens container.

U.S. Pat. No. 4,984,682 to Cummins discloses an eyeglass holder.

U.S. Pat. No. Des. 308,752 to Hall discloses a combined eyeglass case and utility pouch.

U.S. Pat. No. Des. 279,522 to Scoppettone discloses an eyeglass case.

U.S. Pat. No. Des. 244,320 to Cohen discloses an eyeglass case.

U.S. Pat. No. 4,267,923 to Baratelli et al. discloses an eyeglass case.

While these devices fulfill their respective, particular objective and requirements, the aforementioned patents do not describe a case for eyeglasses and sunglasses enabling users to carry both eyeglasses and sunglasses in a single case.

In this respect, the case for eyeglasses and sunglasses according to the present invention substantially departs from the conventional concepts and designs of the prior art, and in doing so provides an apparatus primarily developed for the purpose of enabling users to carry both eyeglasses and sunglasses in a single case.

Therefore, it can be appreciated that there exists a continuing need for new and improved case for eyeglasses and sunglasses which can be used for enabling users to carry both eyeglasses and sunglasses in a single case. In this regard, the present invention substantially fulfills this need.

SUMMARY OF THE INVENTION

In the view of the foregoing disadvantages inherent in the known types of cases for glasses now present in the prior art, the present invention provides an improved case for eyeglasses and sunglasses. As such, the general purpose of the present invention, which will be described subsequently in greater detail, is to provide a new and improved case for eyeglasses and sunglasses and method which has all the advantages of the prior art and none of the disadvantages.

To attain this, the present invention essentially comprises a new and improved case for eyeglasses and sunglasses comprising, in combination: a case formed in first and second elongated generally rectangular shaped sections, the first section being fabricated of rigid plastic and having a front wall, a rear wall, a top wall, a bottom wall and two side walls, the first section including support means comprising two transverse bars each being coupled between the front and rear walls adjacent each side wall, two planar generally rectangular support walls being positioned adjacent each side wall, each support wall including a rounded upper extent, the front wall including a lower section formed contiguously with the bottom wall and an upper section formed contiguously with the top wall, the upper section being formed as a generally triangular shaped flap, the upper section being folded over the lower section and secured by a snap, the first section adapted to contain a pair of eyeglasses; and the second section being fabricated of flexible plastic and having a front wall, a rear wall, a top wall, a bottom wall and two side walls, the front wall being secured to the rear wall of the first section, the top wall including a zipper positioned therein, the rear wall including a generally rectangular shaped clip secured thereto by a plurality of rivets, the second section adapted to retain a pair of sunglasses, in an operative orientation a user storing a pair of eyeglasses and a pair of sunglasses within the apparatus.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved case for eyeglasses and sunglasses which has all the advantages of the prior art cases for glasses and none of the disadvantages.

It is another object of the present invention to provide a new and improved case for eyeglasses and sunglasses which may be easily and efficiently manufactured and marketed.

It is a further object of the present invention to provide a new and improved case for eyeglasses and sunglasses which is of durable and reliable construction.

An even further object of the present invention is to provide a new and improved case for eyeglasses and sunglasses which is susceptible of a low cost of manufacture with regard to both materials and labor, and which accordingly is then susceptible of low prices of sale to the consuming public, thereby making such a case for eyeglasses and sunglasses economically available to the buying public.

Even still another object of the present invention is to provide a new and improved case for eyeglasses and sunglasses for enabling users to carry both eyeglasses and sunglasses in a single case.

Lastly, it is an object of the present invention to provide a new and improved case for eyeglasses and sunglasses comprising a case for eyeglasses and sunglasses comprising: a case formed in first and second sections, the first section having a front wall, a rear wall, a top wall, a bottom wall and two side walls, the front wall comprising a lower section formed contiguously with the bottom wall and an upper section formed contiguously with the top wall, the upper section being formed as a generally triangular shaped flap, the upper section being folded over the lower section and coupled thereto, the first section adapted to contain a pair of eyeglasses; and the second section having a front wall, a rear wall, a top wall, a bottom wall and two side walls, the front wall being secured to the rear wall of the first section, the top wall including a coupling device, the second section adapted to contain a pair of sunglasses, in an operative orientation a user carrying a pair of eyeglasses and a pair of sunglasses within the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
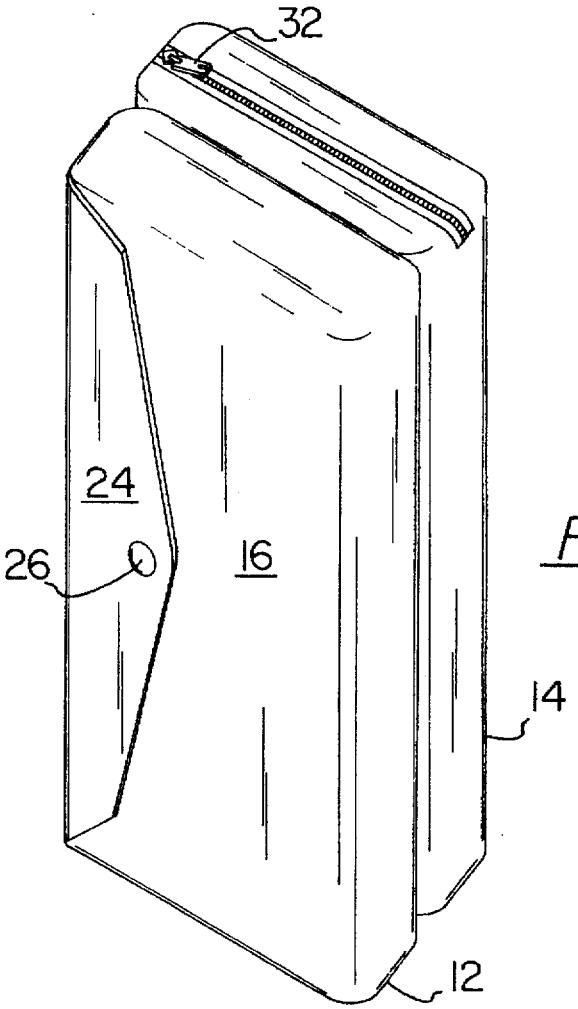
FIG. 1 is a perspective view of the preferred embodiment of the case for eyeglasses and sunglasses constructed in accordance with the principles of the present invention.

With reference now to the drawings, and in particular, to FIG. 1 thereof, the preferred embodiment of the new and improved case for eyeglasses and sunglasses embodying the principles and concepts of the present invention and generally designated by the reference number 10 will be described.

Specifically, it will be noted in the various Figures that the device relates to a case for eyeglasses and sunglasses 10. In its broadest context, the device consists of a first section 12 and a second section 14. Such components are individually configured and correlated with respect to each other so as to attain the desired objective.

Figure 3:
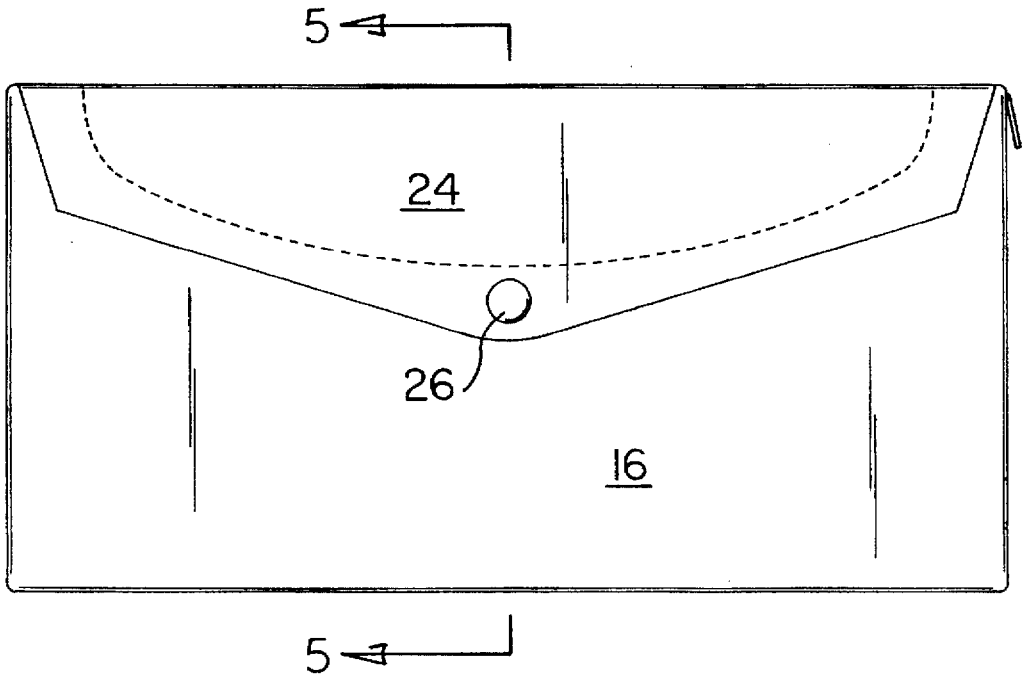
FIG. 3 is a front perspective view of the case for eyeglasses and sunglasses illustrating the eyeglass section of the apparatus.
Figure 4:
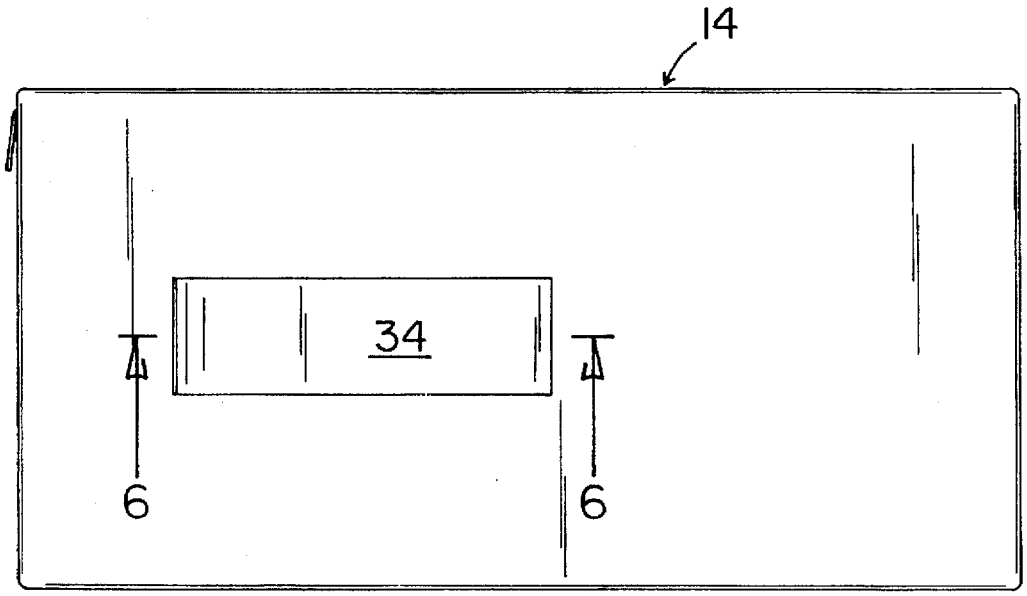
FIG. 4 is a rear perspective view illustrating the clip of the apparatus.
Figure 5:
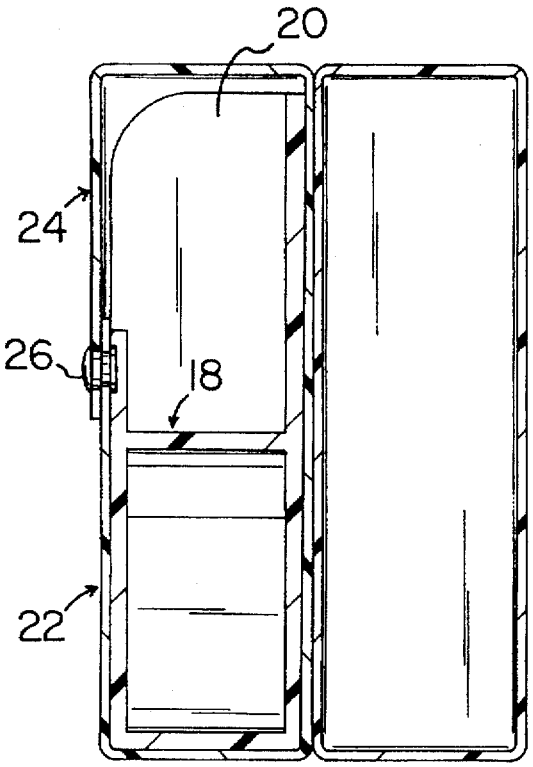
FIG. 5 is a cross-sectional view of the apparatus taken along section line 5—5 of FIG. 3.
Figure 6:
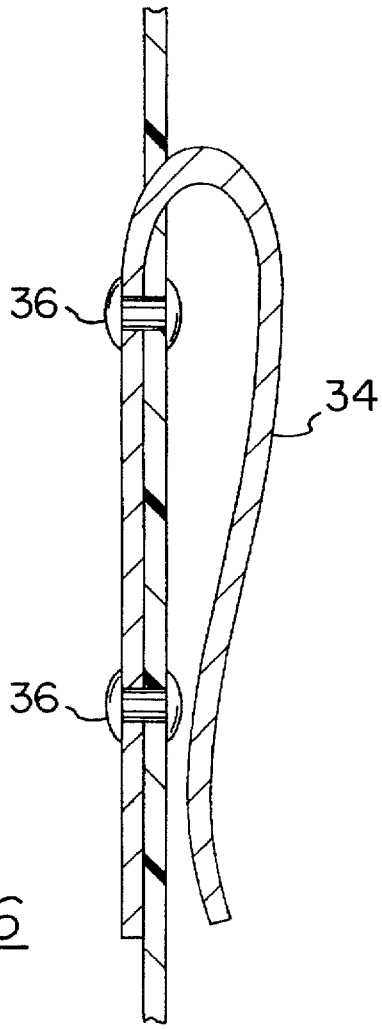
FIG. 6 is a cross-sectional view of the apparatus taken along section line 6—6 of FIG. 4.

More specifically, the case 10 is formed in first and second elongated rectangular shaped sections. In alternate embodiments of the apparatus the sections are shaped in an oval configuration. The first section 12 is fabricated of rigid plastic and has a front wall 16, a rear wall, a top wall, a bottom wall and two side walls. The first section includes support means comprising two transverse bars 18. Each transverse bar is coupled between the front and rear walls adjacent each side wall. Each side wall includes an upper extent with rounded edges. Note FIGS. 1, 3, and 5.

Figure 2:
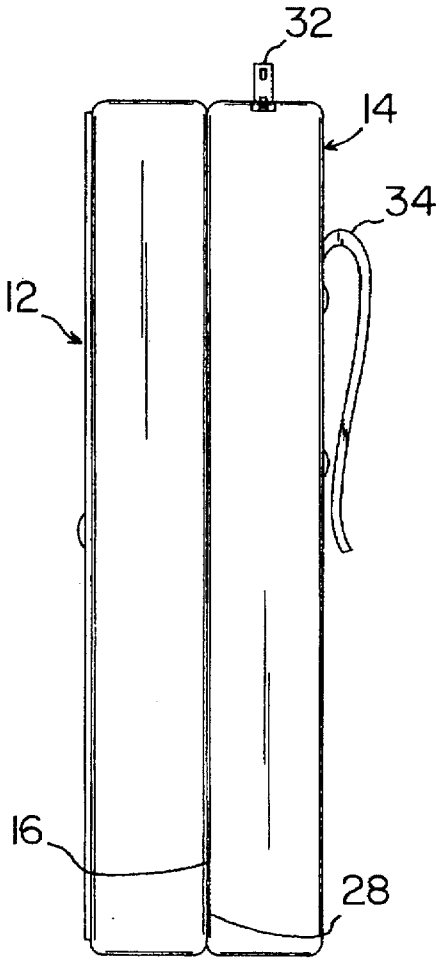
FIG. 2 is a side perspective view of the case for eyeglasses and sunglasses illustrating both sections of the apparatus.

The front wall comprises a lower section 22 formed contiguously with the bottom wall. The upper section 24 is formed contiguously with the top wall. The upper section 24 is formed as a generally triangular shaped flap. In an operative orientation the upper section is folded over the lower section and secured thereto by a snap 26. The first section is adapted to retain a pair of eyeglasses. Note FIGS. 1, 2 and 3.

The second section 14 is fabricated of flexible plastic and has a front wall 28, a rear wall 30, a top wall, a bottom wall and two side walls. In alternative embodiments the case is fabricated of leather or suede. The front wall 28 is secured to the rear wall of the first section. In the preferred embodiment of the apparatus the sections are affixed to each other. The top wall includes a zipper 32 along its length. Note FIGS. 1 and 2.

The rear wall includes a generally rectangular shaped clip 34. The clip is rounded at its upper extent. The clip is secured to the rear wall by a plurality of rivets 36. The clip allows a user to attach the case to a piece of clothing or a sun visor of an automobile. The second section is adapted to contain a pair of sunglasses. In an operative orientation a user stores a pair of eyeglasses, a pair of sunglasses, or both within the apparatus. The present invention provides a user the convenience of carrying his sunglasses and his eyeglasses in the same case. Since many individuals own two pairs of glasses the present invention provides a way to store both pairs in the same location. Note FIGS. 2 and 4–6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved case for eyeglasses and sunglasses comprising, in combination:

a case formed in first and second elongated generally rectangular shaped sections, the first section being fabricated of rigid plastic and having a front wall, a rear wall, a top wall, a bottom wall and two side walls, the first section including support means comprising two transverse bars each being coupled between and integral with the rigid front and rear walls adjacent each side wall, each side wall including an upper extent including rounded upper edges, the front wall including a lower section formed contiguously with the bottom wall and an upper section formed contiguously with the top wall, the upper section being formed as a generally triangular shaped flap, the upper section being folded over the lower section and secured by a snap, the first section adapted to contain a pair of eyeglasses; and the second section being fabricated of flexible plastic and having a front wall, a rear wall, a top wall, a bottom wall and two side walls, the front wall of the second section being affixed to the rear wall of the first section, the top wall including a zipper positioned therein along its length, the rear wall including a generally rectangular shaped clip secured thereto by a plurality of rivets, the second section adapted to retain a pair of sunglasses, in an operative orientation a user storing a pair of eyeglasses and a pair of sunglasses within the apparatus.

* * * * *